United States Patent [19]

Mueller

[11] 4,113,102

[45] Sep. 12, 1978

[54] SCORE LINE CONFIGURATION FOR ICE CREAM CARTONS AND THE LIKE

[75] Inventor: David Charles Mueller, Neenah, Wis.

[73] Assignee: American Can Company, Greenwich, Conn.

[21] Appl. No.: 840,739

[22] Filed: Oct. 11, 1977

[51] Int. Cl.[2] ..... B65D 5/54; B65D 17/24

[52] U.S. Cl. ..... 206/611; 206/609

[58] Field of Search ..... 206/620, 634, 624, 622, 206/607, 608, 611, 609

[56] References Cited

U.S. PATENT DOCUMENTS

| | | | |
|---|---|---|---|
| 3,214,079 | 10/1965 | Andrews et al. | 206/609 |
| 3,326,364 | 6/1967 | Waldrop | 206/608 X |
| 3,620,438 | 11/1971 | Wood | 206/620 X |
| 3,669,345 | 6/1972 | Cote | 206/608 |
| 3,833,165 | 9/1974 | Hoiles | 206/609 X |
| 3,863,834 | 2/1975 | Sandford | 206/611 X |

FOREIGN PATENT DOCUMENTS

| | | | |
|---|---|---|---|
| 1,042,456 | 10/1958 | Fed. Rep. of Germany | 206/620 |

*Primary Examiner*—Davis T. Moorhead
*Attorney, Agent, or Firm*—Robert P. Auber; Ira S. Dorman; Ernest L. Brown

[57] ABSTRACT

A new score line configuration having easy opening characteristics for opening an ice cream carton and the like, has the characteristic of avoiding premature separation particularly during set up of the carton.

8 Claims, 4 Drawing Figures

SCORE LINE CONFIGURATION FOR ICE CREAM CARTONS AND THE LIKE

BACKGROUND OF THE INVENTION

For closing or sealing some ice cream cartons have their end panels folded in, and they are unfolded to open the carton. Others have various kinds of scored tear configurations on the end panel. For example, one tear configuration uses a straight line of cut scores. Another configuration uses cut scores only the back corner of the end flap on the top panel. Still another configuration uses a plurality of cut scores shaped generally in the shape of S or Z. The S or Z is usually slanted.

Frequently the carton is not easily opened, and one must tear the lid or the side to obtain the enclosed ice cream.

If the blank is grasped in the margin outside the score lines by the folding machine which sets up the carton, premature separation frequently occurs.

Even after the carton is set up and filled with ice cream, when the date is impressed upon the margin it frequently happens that the score line tears.

It also frequently happens that shear forces in the one direction on the upper margin of the upstanding end panel and in the other direction on the end panel main or bottom portion substantially in the direction of the line of the cut score configuration cause the cut scores to open.

BRIEF DESCRIPTION OF THE INVENTION

The tear strip configuration of this invention is an intermittent series of aligned dashed cut scores with the spaces between the cut score segments each having a diagonal cut score which preferably is made in two pieces with a space substantially in the middle and substantially aligned with the dashed cut scores. The extensions of the diagonal cut scores extend parallel, juxtaposed and spaced apart from the dashed cut scores to form a configuration substantially in the shape of a tilted Z with a space in the middle of the diagonal. That configuration has been found to be sufficiently strong to avoid accidentally tearing the margin off of the end panel and sufficiently weak to allow easy opening of the carton.

It is therefore an object of this invention to provide a new cut score configuration for opening a carton.

BRIEF DESCRIPTION OF THE DRAWINGS

Other objects will become apparent from the following description taken in connection with the accompanying drawings, in which.

DETAILED DESCRIPTION OF THE INVENTION

Figure 1:
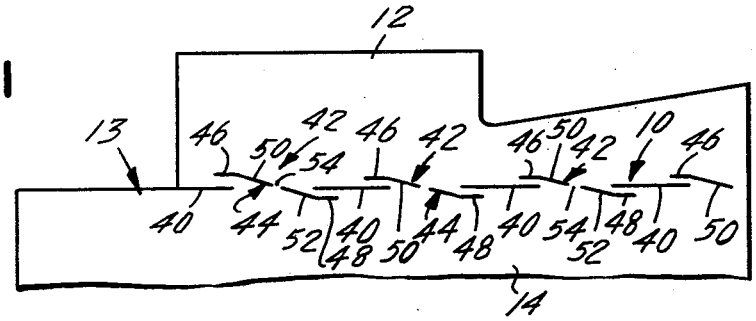
FIG. 1 shows a portion of an end panel of an ice cream carton with the cut score configuration of this invention thereon.
Figure 2:
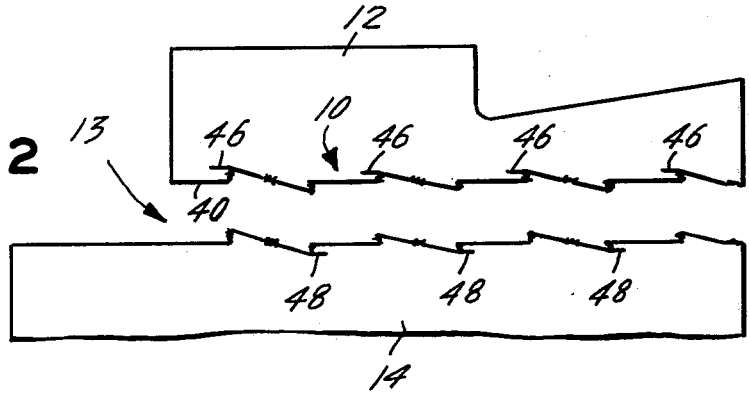
FIG. 2 shows the cut score of FIG. 1 after it is torn apart.
Figure 3:
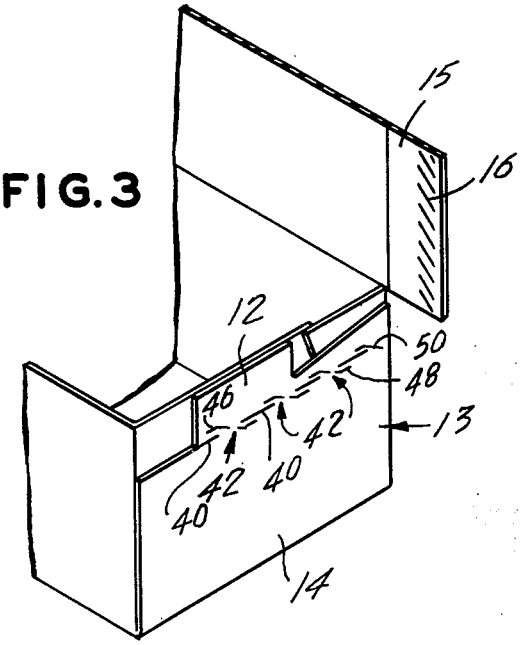
FIG. 3 shows an ice cream carton together with the upstanding end panel having the cut score configuration of this invention.
Figure 4:
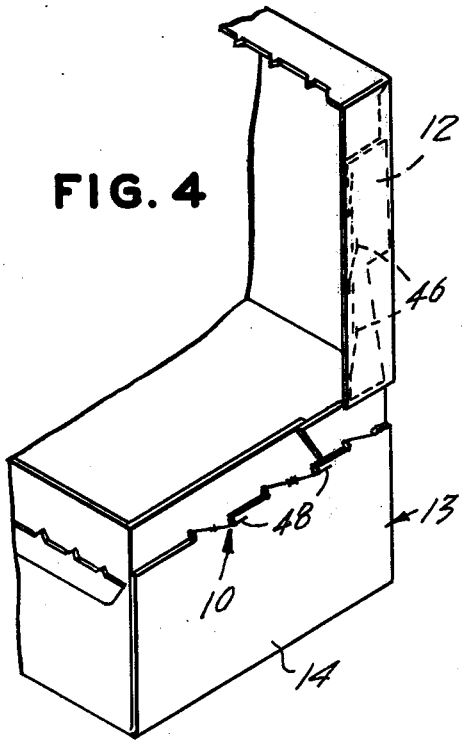
FIG. 4 shows the carton in opened position with the cut score torn.

In the Figures, a portion of the bottom end flap of an ice cream carton is shown in FIGS. 1 and 2, and the end of the carton itself is shown in FIGS. 3 and 4.

The cut score configuration 10 of this invention separates the outer margin 12 and the main portion 14 of the upstanding end panel 13 of an ice cream carton.

Typically in the assembly of the carton, the margin 12 is grapsed by an assembly machine, and other configurations of cut score allow the margin 12 to be torn off. With the cut scores of this invention the margin 12 is not torn off.

FIGS. 3 and 4 show how the end flap of the top panel of the ice cream carton has an adhesive or hot melt plastic 16 along the outer margin thereof to fasten that flap 15 to the outer margin 12 of the upstanding end panel 13. With the flap 15 attached to the outer margin 12, opening of the ice cream carton tears the cut score configuration 10 of this invention as shown in FIGS. 2 and 4.

The preferred cut score configuration is shown in the Figures.

Intermittent aligned cut scores 40 are spaced along and aligned in the principal tear direction of the configuration. Between the cut scores 40 are slanted Z configured cut scores 42. Each of the cut score configuration 42 comprises a diagonal cut score 44 extending from one end of a cut score 40 to the adjacent end of the next cut score 40 and a pair of end extensions 46 and 48 attached to the ends of the diagonal cut scores 44 on opposing sides of the line of cut score 40. The cut scores extensions 46, 48 are substantially parallel to, juxtaposed and spaced apart from the cut scores 40. The diagonal or slanted cut scores 44 are preferably broken or separated into two portions 50 and 52 by a separation space 54. The extensions 46 and 48 overlap or are juxtaposed with the cut scores 40, and the tear, when opened, is between members 40 and the adjacent cut scores 46, 48 as well as through the spaces 54.

In the shown embodiment, three Z cut scores 42 are shown together with a one-half of a Z cut score. The one-half of the Z cut score occurs merely because it reaches a predetermined distance from the edge of a particular dimension of the carton from which the cut score drawing was taken.

It was considered to make the tearing of the configuration slightly harder to start than to continue the tear. To that end, the left hand spacing between member 40 and 46 in a typical ice cream carton may be, for example, 3/32 of an inch while the spacing of the remaining end cut extensions 46 and 48 are spaced 1/16 of an inch away from their adjacent cut scores 40. The cut scores 40 are typically ½ inch long.

The first slanted cut score 44 to the left may form a larger angle with respect to the direction of cut scores 40, 46 and 48 than does the centrally located slanted cut scores 44. For example, the first cut scores may be at 17° and 30 minutes while the remaining cut scores are at 14°. It may also be desirable to make the angle of slanted cut score 44 at the extreme right rather steep at an angle of, for example, 26° and 30 minutes. The spacing 54 may typically be 0.025 inch.

Thus the particular cut score configuration claimed herein is a stronger than usual cut score configuration which is easily opened by a user.

Although the invention has been described in detail above, it is not intended that the invention shall be interpreted by that description above but only in combination with the appended claims.

I claim:

1. A score line configuration comprising:

a plurality of intermittent aligned cut scores which are spaced along and aligned in the principal tear direction of said configuration;

a plurality of slanted Z configured cut scores in the spaces between said aligned cut scores, each having a diagonal cut score extending from one end of a said aligned cut score to the adjacent end of the next aligned cut score, and a pair of cut score end extensions attached to the ends of said diagonal cut scores, said extensions being parallel to, juxtaposed with, and spaced apart from said aligned cut scores.

2. The score line configuration of claim 1 wherein said diagonal cut scores are each separated into two portions with a separation space therebetween.

3. The score line configuration of claim 1 wherein the angle of inclination of said diagonal cut scores relative to said aligned cut scores is between 14° and 26° thirty minutes.

4. The score line configuration of claim 1 wherein said cut score extensions on each said diagonal cut score are on opposing sides of the line of said aligned cut scores.

5. The score line configuration of claim 4 wherein the angle of inclination of said diagonal cut scores relative to said aligned cut scores is between 14° and 26° thirty minutes.

6. The score line configuration of claim 5 wherein said cut score end extensions are spaced apart from said aligned cut scores by between 1/16 inch and 3/32 inch.

7. The score line configuration of claim 6 wherein said diagonal cut scores are each separated into two portions with a substantially 0.025 inch separation spaced therebetween.

8. The score line configuration of claim 4 wherein said diagonal cut scores are each separated into two portions with a separation space therebetween.

* * * * *